United States Patent [19]

Leliaert

[11] 4,296,794

[45] Oct. 27, 1981

[54] METHOD OF TRANSMISSION OF SONIC ENERGY TO WORK PIECES

[75] Inventor: Raymond M. Leliaert, South Bend, Ind.

[73] Assignee: Wheelabrator-Frye Inc., Hampton, N.H.

[21] Appl. No.: 111,487

[22] Filed: Jan. 14, 1980

[51] Int. Cl.[3] ..... B22D 29/00

[52] U.S. Cl. ..... 164/131; 164/250.1; 164/401

[58] Field of Search ..... 164/71, 39, 260, 83, 164/261, 416, 131, 132, 344–346, 404, 250, 401; 148/12.9; 366/116, 127; 198/766–770; 414/415, 363, 375, 525 A; 173/49; 74/26, 61, 87

[56] References Cited

U.S. PATENT DOCUMENTS

| | | | |
|---|---|---|---|
| 1,762,416 | 6/1930 | Pickop | 164/261 X |
| 1,869,112 | 7/1932 | Nichols | 164/261 |
| 4,229,046 | 10/1980 | Gurries | 173/49 X |

*Primary Examiner*—Robert D. Baldwin
*Assistant Examiner*—K. Y. Lin
*Attorney, Agent, or Firm*—McDougall, Hersh & Scott

[57] ABSTRACT

Apparatus for transmission of sonic energy to the processing of work wherein the sonic energy is transmitted through a vibratory member to a fixture having spaced abutment surfaces in which the clearance between one abutment surface and the adjacent surface of the work piece, while the work piece is at rest on the other abutment surface, is equal to ±50% of the amplitude of the vibrations at the point of attachment of the fixture to the vibration generator.

3 Claims, 8 Drawing Figures

METHOD OF TRANSMISSION OF SONIC ENERGY TO WORK PIECES

This invention relates to a method and means for transmitting sonic energy to a work piece for utilization of the sonic energy in the processing or treatment of the work piece and it relates more particularly to a fixture in which the work piece is retained for the transmission of the sonic energy thereto.

It is an object of this invention to provide a method and means for transmission of sonic energy to a work piece whereby efficient and effective use can be made of the energy transmitted in processing or in the performance of some beneficial effect on the work piece.

The invention will be described with reference to the removal of cores from a metal casting with particular reference being made to castings made of aluminum because of the low temperature at which the aluminum is cast whereby thermal decomposition of the binder is minimized thereby to introduce problems in the removal of the cores from the solidified casting. It is for this reason that the industry has not been able to make use of conventional shakeout systems for sand core removal. The use of abrasive blast systems for the removal of cores is also difficult, especially in aluminum castings, by reason of damage to the castings.

Other conventional means for the removal of cores from castings by treatment with liquids for dissolving out the cores is not only slow and cumbersome but very expensive, and impacting of the castings with percussion tools is inconclusive and often destructive to the cast metal part.

Thus it is an object of this invention to provide a method and means for utilization of sonic energy with means for transmission of such energy to the cored metal casting whereby the core is removed quickly, efficiently and effectively without damage to the casting.

These and other objects and advantages of this invention will hereinafter appear and for purposes of illustration, but not of limitation, embodiments of the invention are shown in the accompanying drawings in which.

Figure 1:
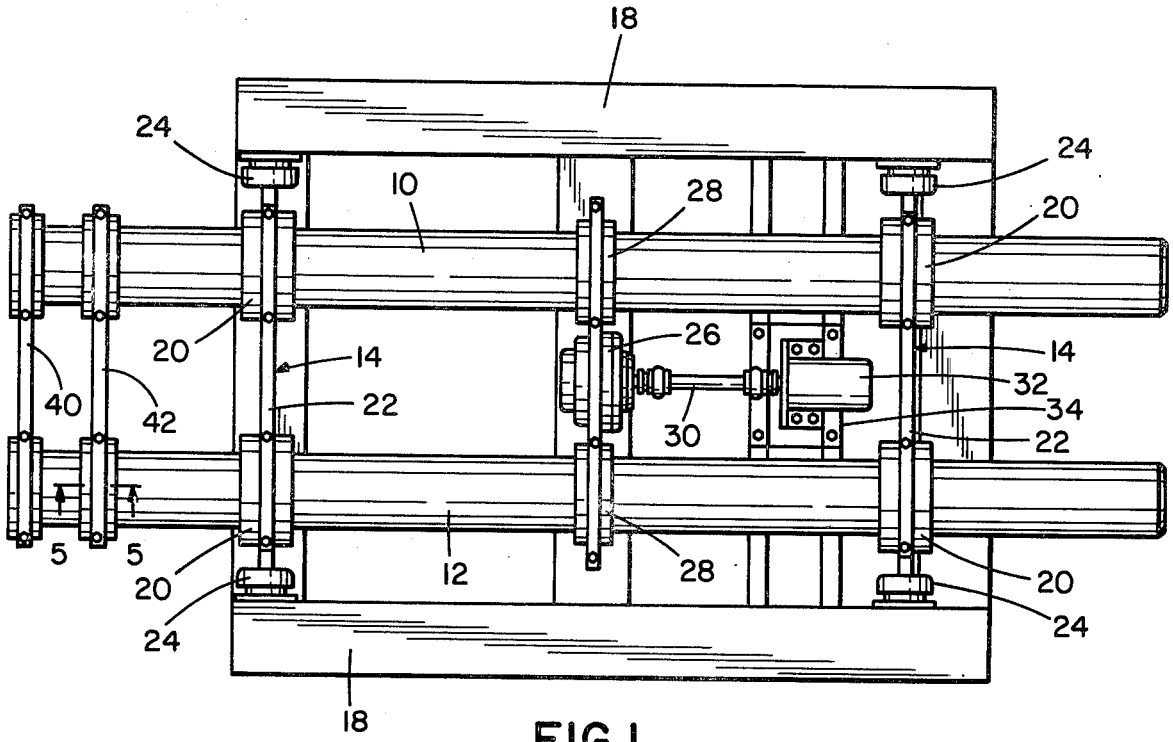
FIG. 1 is a top plan view of the vibratory device employed in the practice of this invention.
Figure 2:
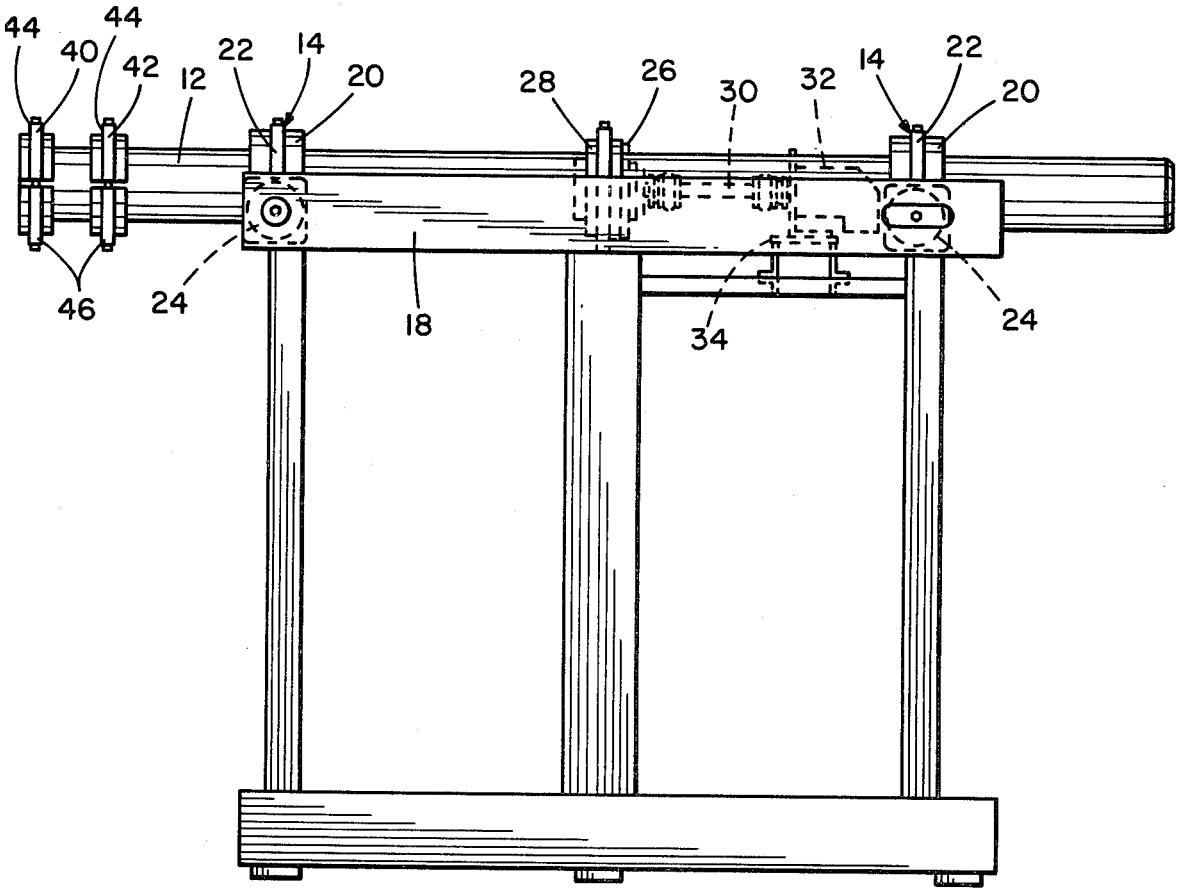
FIG. 2 is a side elevational view of the device shown in FIG. 1.

It will be understood that the concepts of this invention, as applied to core knockout of aluminum castings, will have equal application to the removal of cores from castings other than of aluminum, such as from casting formed of other metals, such as steel, superalloy, zinc, titanium, zirconium, silver, gold and other metals and alloys, and to the removal of castings from mold parts and the cleaning of castings and that the means for utilization of such transmitted energy has application to the processing of other parts and materials and will become obvious from the description hereafter given of the invention.

Applicant does not claim to be the inventor of the sonic vibration generator. Briefly described, the sonic vibrator generator, employed in the practice of this invention, comprises an orbiting-mass oscillator formed of a pair of elongated resonator members, such as elongated hollow tubes 10 and 12 formed of high strength, highly elastic material such as steel. The tubes are resiliently supported by bulkheads 44 and 46 onto a rigid frame 18 by means of compliant saddle 20 clamp plate assemblies 22 spaced one from the other along the length of the tubes at positions corresponding to the nodes of a standing wave pattern (FIG. 3) set up in the resonant vibration system formed by the tubes. The mounting brackets are attached to the frame members via cup mounts 24 to isolate sound and to minimize shear.

An orbital-mass oscillator 26 is fixedly attached to the tubes 10 and 12 by means of a clamping plate assembly 28 which extends crosswise of the tubes to support the oscillator therebetween. The orbital-mass oscillator has an eccentric rotor (not shown) member mounted for rotational movement in a plane perpendicular to the axis of the tubes and is connected by a shaft 30 to a driving motor 32 in the form of an electrical or hydraulic motor mounted on beams 34 supported by the frame members 18 whereby the oscillator is adapted to be rotated to a speed to generate vibratory energy at a sonic frequency.

Figure 3:
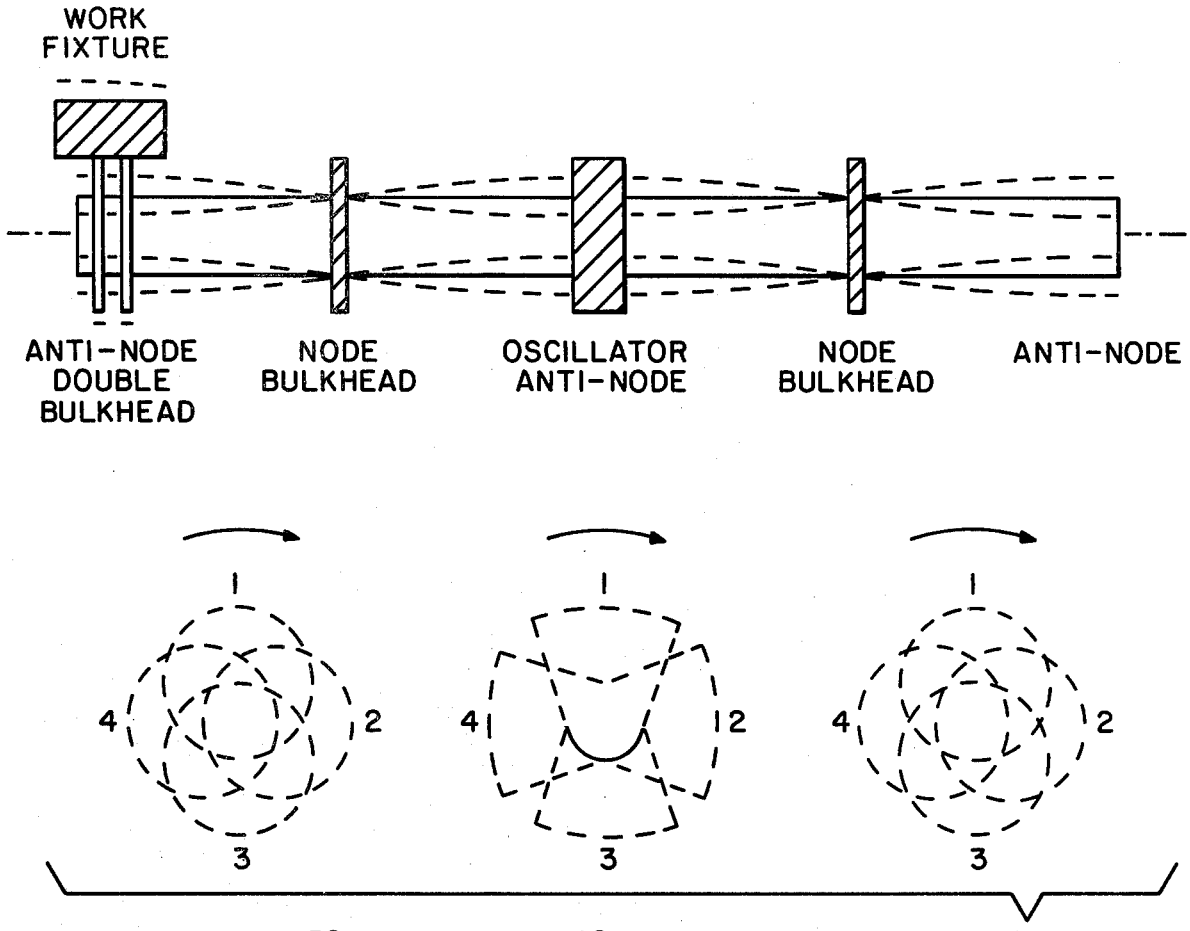
FIG. 3 is a standing wave pattern generated by the vibratory device of FIG. 1.
Figure 4:
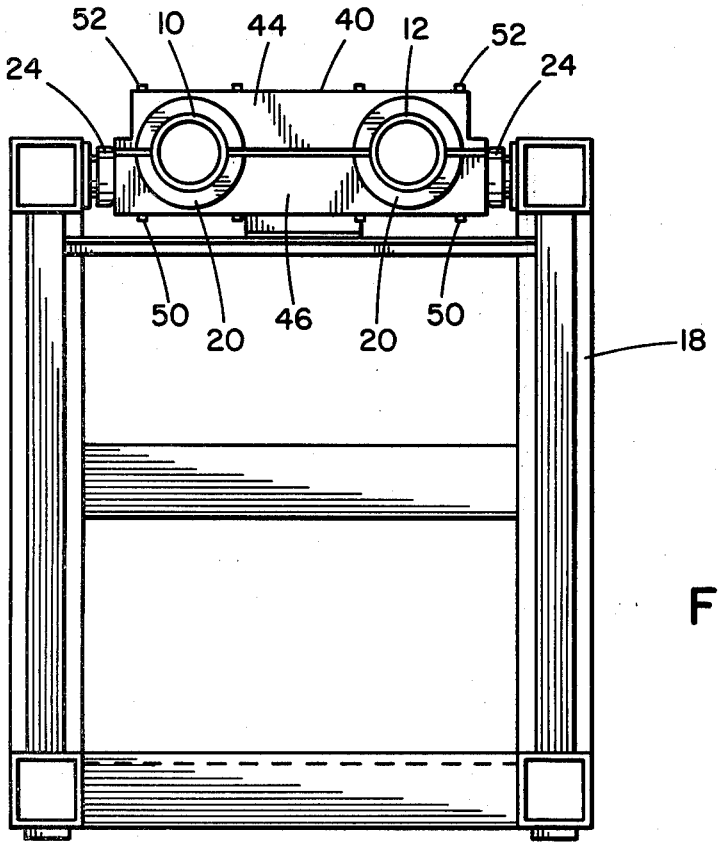
FIG. 4 is a front elevational view of the bulkhead mounting on the ends of the tubular members.
Figure 5:
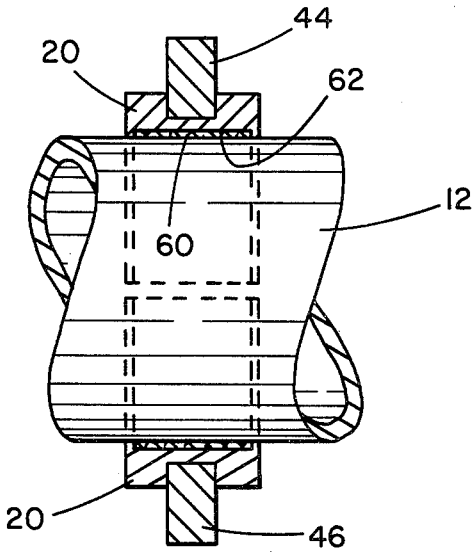
FIG. 5 is a sectional view showing the saddle clamp mounting for the bulkheads.

The speed of rotation is adapted to provide a vibratory output from the oscillator 26 which causes resonant standing wave vibrations of the resonator tube members 10 and 12, as indicated by the standing wave graph pattern of FIG. 3.

The tubes are thus supported at the two node points which theoretically have minimum amplitude, do not move, and are the points of minimum energy output. The center and extreme ends of the resonant power tubes 10 and 12 are referred to as anti-nodes. The anti-nodes are characterized by having maximum amplitude and energy output.

The fixture, embodying the features of this invention for transmission of energy from the orbital-mass oscillator to a work piece, is adapted to be mounted by attachment to the resonant tube members at one or the other or both anti-nodes of the standing wave pattern. A work fixture is required to retain the work piece and to transmit the energy of the anti-nodes of the orbital transmission system into the work pieces.

While a fixture for supporting the work can be employed at each of the anti-node locations, it is preferred to make use of a single fixture connected to the tubes at one of the anti-node locations and the invention will hereinafter be described with respect thereto, it being understood that the construction to be described can be duplicated when use is made of the other anti-node location.

It has been found that in order to achieve a workable attachment of the fixture to the resonant tubes 10 and 12, it is important to make use of at least two longitudinally spaced, crosswise extending, interconnected bulkheads 40 and 42 clamped onto the end portions of the tubes. When use is made of but a single bulkhead for interconnection of the resonant tubes with the fixture, such leveraged loads are developed in operation as to cause almost immediate destruction of the connecting bolts as well as deterioration of equipment. It has been found that it is necessary to provide for a rigid support between the fixture and the resonant tubes such as can be achieved by double, triple or multiple interconnected bulkheads to which the fixture can be attached.

In the illustrated modification, use is made of a pair of bulkheads 40 and 42 formed of upper and lower steel plates 44 and 46 dimensioned to extend crosswise of the tubes 10 and 12 with each bulkhead provided with saddle clamps 20 in the form of semicircular sections with the saddle clamps spaced crosswise by an amount corresponding to the spacing of the tubes so as to embrace the tubes therebetween. The upper and lower sections 44 and 46 of the bulkhead are joined by elongate bolts 50 extending through aligned openings. The through extending end portions are threaded for threaded engagement by nut members 52 whereby the saddle clamps can be tightened to grip the tubes therebetween securely to mount the bulkheads onto the anti-nodes of the resonant tubes. The bolts 50, which are formed of high tensile strength steel, are preferably fabricated, plunge ground and then surface peened to place the bolts under compressive stress for improving fatigue resistance after which threads are rolled onto the end portions thereof.

In assembly, the nut members 52 are tightened onto the opposite ends of the bolts until the desired stress is achieved, as measured by the elongation of the bolt.

It has also been found that direct metal to metal contact between the clamping saddle members and the tubes normally results in the buildup of excessive amounts of heat during the transmission of the energy from the tubes to the bulkheads with the result that parts are subject to excessive deterioration. This problem can be overcome by providing a compliant member between the saddles and the tubes to permit some relative movement between the parts. However, when rubber, plastic or other organic material is employed for this purpose, the compliant member has been found rapidly to deteriorate under the conditions of use. The desired results have been achieved by the use of a compliant material formed of interbonded, soft, compliant, inorganic fibers, such as asbestos, with our without binder. The asbestos is provided in the form of a tubular or ring section 60 which is adapted to seat within an annular groove 62 formed in the inner peripheral surface of the saddle members 48 and dimensioned to have a thickness greater than the depth of the grooves so as to extend beyond the saddle members into pressure engagement with the gripped peripheral portion of the tubes whereby the compliant material is compacted when the saddles of the bulkheads are properly mounted on the tubular members.

The important concept of this invention resides in the fixture which is secured to the bulkheads for conjoint movement therewith. The fixture is generally in the form of an enclosure having an open end for the displacement of the part to be processed into and out of the enclosure.

A significant feature of the fixture resides in the relative movement permitted to occur between the part and the fixture, when measured in the direction perpendicular to the plane formed by the axis of the orbo-resonance tubes (or the major dimension of the orbital movement at the anti-node) as compared to the amplitude at the anti-node in the same direction. The amount of movement permitted is determined, in accordance with the practice of this invention, by the clearance between one or more abutments in the fixture and an upper surface of the part while at rest in the fixture. Optimum effect is secured when the clearance is equal to the amplitude of the tubular members at the anti-node or point of attachment. Under these conditions, during operation, the work is impacted at vibration frequency between its support and the abutment with the transmission of energy sufficient to cause almost immediate disintegration of the core. In affect, the portion of the core immediately adjacent the walls of the casting is crushed in response to such activation whereby the core is freed for removal, with or without subsequent disintegration by continued operation.

It is preferred to continue sonic vibration for orbital resonance for a short period of time further to break up the core into smaller segments whereby the core material can operate to burnish the surface of the casting, as an added benefit, and whereby the core material can be broken down into small particles for flow from the casting for substantially complete removal. It is undesirable to subject the work piece to prolonged treatment since the energy transmitted is of such magnitude as possibly to bring about breakdown of the part.

When the clearance exceeds the amplitude by more than 50%, the part tends to float between its support and the abutment with the result that little if any impact occurs between the part and fixture for core removal. While impact at orbital frequency will occur when the tolerance is less than the amplitude, the effect is materially reduced so that it is undesirable to provide for a tolerance that is less than 50% of the amplitude.

The abutment or abutments should be arranged so that the casting or other part is engaged in areas that will tolerate such impacts and such metal flow as may occur as a result thereof, as when the formed parts are of softer metals such as cast aluminum. It is preferred to locate the abutments to engage the part over an extended area whereby the load can be distributed with correspondingly less danger of deformation or destruction of the part.

The supporting fixture is adapted removably to be secured to the bulkheads 40 and 42 for movement therewith. The fixture can be secured to extend below the bulkheads, above the bulkheads, or in axial alignment with the tubes, alongside or in endwise alignment with the tubes.

Figure 6:
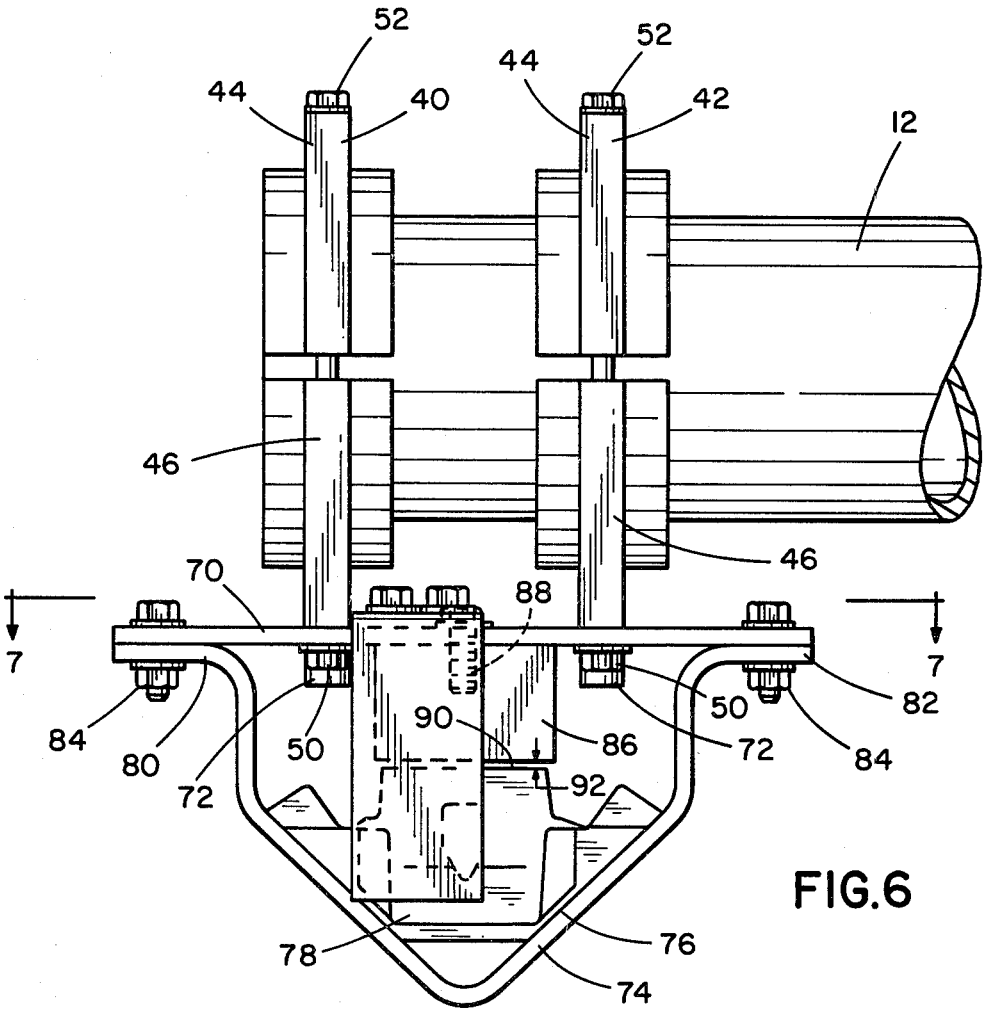
FIG. 6 is a side elevational view of a fixture embodying the features of this invention with a casting therein in position of use.
Figure 7:
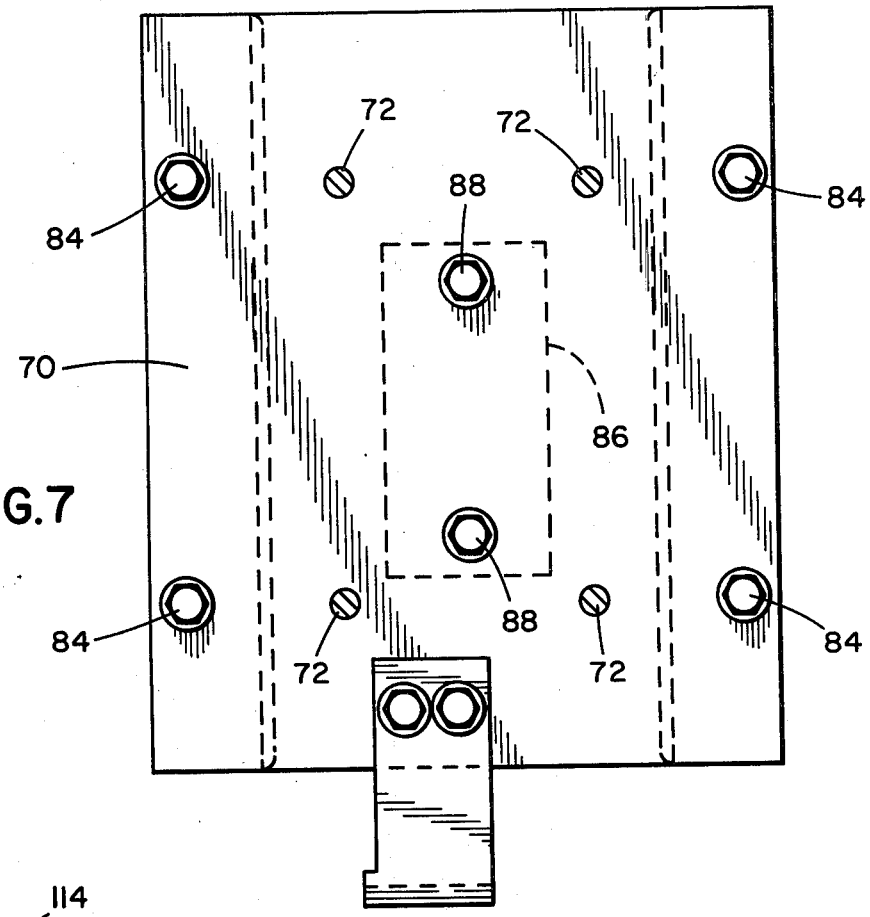
FIG. 7 is a top plan view of the fixture of FIG. 6.

FIGS. 6 and 7 are illustrative of fixtures embodying the features of this invention.

FIG. 6 is a schematic illustration showing the concepts of the invention. In FIG. 6, the fixture is formed of a top plate 70 rigidly secured by bolts 72 to the pair of bulkheads 40 and 42 to establish a rigid interconnection therebetween. A bottom plate 74 is formed with a central V-shaped section 76 to conform to the contour of the underside of a casting 78 to be inserted therein for processing. The forward and rearward upper edge portions 80 and 82 of the bottom plate extend as flanges in parallel relation with the underside of the top plate 70 for attachment thereto, as by bolt and nut means 84.

The joined top and bottom plates 70 and 74 form a housing therebetween which is open at one end to enable the casting 78 or other part to be displaced into and out of the housing. The other end may be closed or open. When open, it is desirable to provide a stop to block the displacement of the casting or part therethrough.

The important feature resides in the clearance between an abutment 86 secured, as by bolt means 88 to the underside of the top plate and the upper adjacent surface 90 of the casting 78 when at rest on the bottom wall 74 of the housing. In the illustrated modification, the orbo-resonant tubes 10 and 12 are operated to vibrate at a frequency of ≈100 Hertz or 6,000 vibrations per minute at an amplitude, at the anti-node, of 4 mm. Under these conditions, the clearance 92 between the abutment 86 and the adjacent top surface 90 of the casting at rest in the housing is adapted to correspond to the amplitude of 4 mm.

In operation, the impacts between the casting 78 and the housing occur at vibration frequency. Within a few seconds or fractions thereof, the sand particles of the core are seen to flow from the casting into the housing and from the open ends of the housing. Within a matter of a few seconds, up to about 15 seconds, the operation of the resonance tubes can be terminated and the cleaned casting removed from the housing.

When operating with a housing open at both ends, an in-line arrangement can be provided for the continuous or intermittent feed of casting or parts through the housing, in one end and out at the other. In the alternative, the casting or part can be displaced into and out of one end of the housing.

Figure 8:
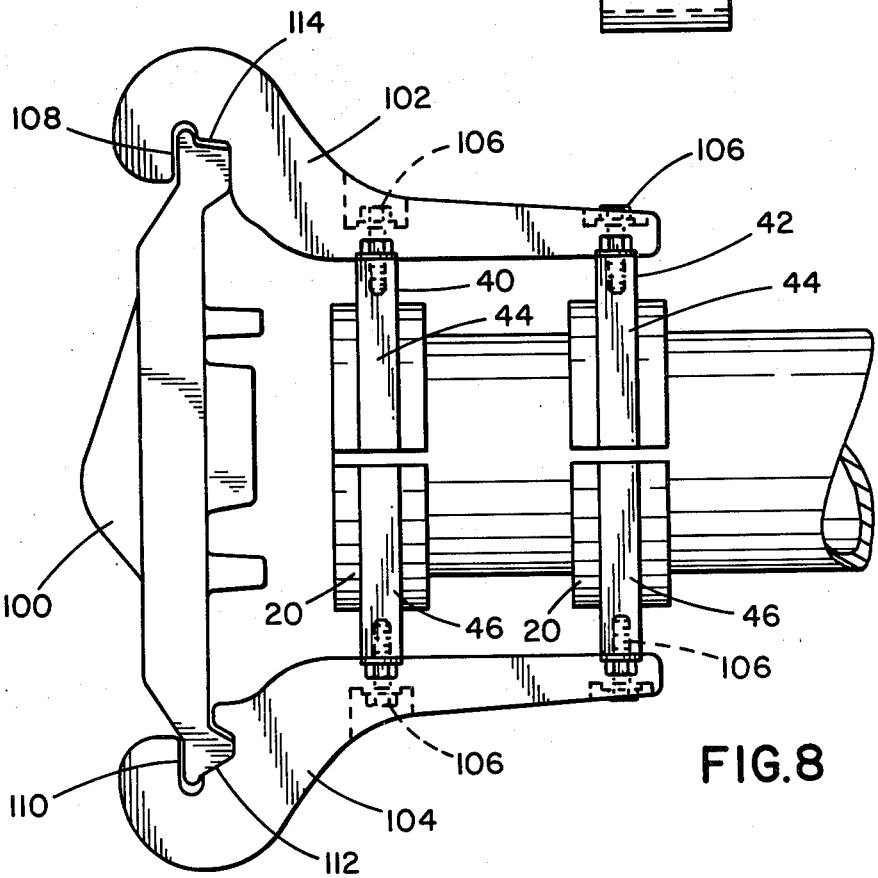
FIG. 8 is a side elevational view of another embodiment of a fixture embodying the features of this invention.

In the modification shown in FIG. 8, illustration is made of a casting 100 inserted between rigid vertically spaced arms 102 and 104 rigidly secured at their rearward end portions, as by means of bolts 106, to the pair of bulkheads 40 and 42 for interconnection therebetween. The arms extend forwardly of the pair of bulkheads with the casting adapted to be disposed therebetween. Each arm 102 and 104 is formed at its outer ends with open ended facing grooves 108 and 110 adapted to conform somewhat to the configuration in the end portions of the casting or part 100. The casting 100 is inserted endwise into and out of the grooves. The lower abutment comprises the bottom wall 112 of the groove on which the lower edge of the casting normally rests. The upper abutment comprises the top wall 114 of the groove 108 in the upper arm 102 with a tolerance or spacing of 4 mm between the adjacent upper edge of the casting and the abutment so that the casting moves between the abutments at an amplitude corresponding to the amplitude at the anti-node during operation of the device.

The other tolerences are not important since vibratory movement in such other directions are insignificant. It is only desirable that sufficient tolerance be available for easy movement of the part or casting into and out of the described holder without letting the part fall from the holder.

It will be apparent that the foregoing concepts can be adapted to various holders, housings and containers for processing of castings or other parts in accordance with the practice of this invention.

Instead of utilizing the vibratory energy transmitted from the orbo-resonant tubes for the removal of core and the cleaning of castings, the energy released can be utilized in other processing operations wherein the casting or part is contained within a housing embodying the described tolerances but in which fluid or other particulate matter is contained within the housing for surface treatment or finishing of the casting or part.

Transmission of sonic energy by orbo-resonance, as employed in the practice of this invention, relates to the production of magnified sonic power by creating a resonance response in an elastic system through the application of periodic force reaction mechanically generated by an orbiting body which is driven by a power source as described in U.S. Pats. No. 2,796,702; No. 2,960,314; No. 3,217,551; No. 3,229,722; No. 3,308,671; No. 3,380,195; No. 3,544,292; and No. 3,496,677.

In the practice of the invention, the desired transmission of sonic energy can be effected at frequencies within the sound range such as frequencies without the range of 10–15,000 Hz and preferably about 100 Hz. The lower the frequency, the higher the amplitude in resonance. The higher the frequency, the lower the amplitude in resonance.

It will be understood that changes may be made in the details of construction, arrangement and operation, without departing from the spirit of the invention, especially as defined in the following claims.

I claim:

1. A method for transmitting vibratory energy to a part from a vibratory member adapted to vibrate at sonic frequency comprising securing a fixture to said vibratory member, said fixture having spaced abutment surfaces, inserting the part into the fixture to between said abutment surfaces whereby the clearance between one abutment surface and the adjacent surface of the work piece, while the work piece is at rest on the other abutment surface, is within the range of ±50% of the amplitude of the vibrations at the point of attachment of the fixture to the vibration generator.

2. A method for knocking out cores from metal castings by sonic energy transmitted from a vibratory member mounted for vibration at sonic frequency, comprising securing a fixture to said vibratory member having spaced abutment surfaces, inserting the casting into said fixture for disposition between said abutment surfaces whereby the clearance between one abutment surface and the adjacent surface of the work piece, while the work piece is at rest on the other abutment surface, is within the range of ±50% of the amplitude of the vibrations at the point of attachment of the fixture to the vibration generator.

3. The method as claimed in claim 2 in which the abutment surfaces are vertically spaced in the fixture and the casting, when inserted, rests on the lower abutment surface to provide a spaced relation between the upper abutment surface and the upper surface of the casting which is substantially equal to the amplitude.

* * * * *